United States Patent [19]

Doherty, III

[11] 4,391,086

[45] Jul. 5, 1983

[54] APPARATUS FOR RESTRINGING MULTIPLE THREADLINES

[75] Inventor: Charles H. Doherty, III, Nashville, Tenn.

[73] Assignee: E. I. Du Pont de Nemours & Co., Wilmington, Del.

[21] Appl. No.: 357,856

[22] Filed: Mar. 15, 1982

Related U.S. Application Data

[63] Continuation-in-part of Ser. No. 237,615, Feb. 24, 1981, abandoned.

[51] Int. Cl.[3] ..... B65H 69/06; D02J 1/08

[52] U.S. Cl. ..... 57/22; 28/274

[58] Field of Search ..... 57/22, 23, 350, 202; 28/271-276; 19/66 R, 66 T

[56] References Cited

U.S. PATENT DOCUMENTS

| | | | |
|---|---|---|---|
| 3,090,268 | 5/1963 | Edwards | 83/100 |
| 3,583,048 | 6/1971 | Gutmann, Jr. | 19/66 R X |
| 3,732,678 | 5/1973 | Berry, Jr. | 57/22 |
| 3,750,302 | 8/1973 | Smith | 28/271 X |
| 3,807,270 | 4/1974 | Wirz | 57/22 X |
| 3,863,435 | 2/1975 | Johnson | 57/22 |
| 4,002,013 | 1/1977 | Johnson et al. | 57/22 |
| 4,199,928 | 4/1980 | Cristaldi | 57/22 |

*Primary Examiner*—John Petrakes

[57] ABSTRACT

An apparatus to recover and restring a broken threadline in a processing multiple running threadlines includes a waste suction device to collect the broken threadline, an interlacing jet to splice the broken threadline onto a running threadline, a forwarding jet to maintain tension on the broken end, a coanda surface at the exit end of the forwarding jet to deflect the broken end into the suction device. While the broken end travels over a notched swing pin to the waste suction device the swing pin is moved to contact the running end which is pulling the broken end spliced to it forward. The action of the swing pin and a pin or cutter blade at the exit of the forwarding jet serves to sever the filaments of the tensioned broken-end threadline which results in a double end running to a sucker gun at the windup. The ends are then separated, placed in the proper guides and restrung.

4 Claims, 9 Drawing Figures

APPARATUS FOR RESTRINGING MULTIPLE THREADLINES

This application is a continuation-in-part application of my prior copending application Ser. No. 237,615, filed Feb. 24, 1981 and now abandoned.

BACKGROUND OF THE INVENTION

This invention relates to an apparatus for stringing multiple threadlines in high speed yarn processing equipment, and more particularly, it relates to apparatus for restringing a threadline by splicing it to one which is running and serves as a carrier through the processing equipment to the vicinity of the windup where the threadlines can be separated and wound into packages.

U.S. Pat. No. 3,863,435 granted Feb. 4, 1975, of common assignee discloses a method for restringing an unstrung threadline in an apparatus processing multiple, closely spaced threadlines moving at high speed. While this method has proven successful, the yarn handling devices for retrieving the unstrung threadlines have been rather ineffective.

SUMMARY OF THE INVENTION

The present invention comprises an improved apparatus for retrieving, splicing and securing the unstrung threadline after it has been spliced to a running threadline of a multiple threadline. The apparatus includes a jet for interlacing the unstrung with a running threadline and a forwarding jet located downstream of the interlacing jet. The forwarding jet has an inlet and outlet through which the multiple threadlines pass and a coanda surface at its outlet end. A suction device is located below the coanda surface to collect the unstrung threadline. A first guide is located across the threadline path contacting the multiple threadlines adjacent the outlet of the forwarding jet. A second elongated pin having a centrally located notch in its surface is pivotally mounted at the outlet end of the forwarding jet for swinging movement from a location below the coanda surface and above the suction device past the suction device to a location between the outlet of the forwarding jet and the first guide pin and above and across the threadline path.

An alternate preferred embodiment includes a cutter blade pivotally mounted between the first guide and the elongated pin for swinging movement to a location adjacent to the path taken by the elongated guide.

DETAILED DESCRIPTION OF THE PREFERRED EMBODIMENT

Figure 1:
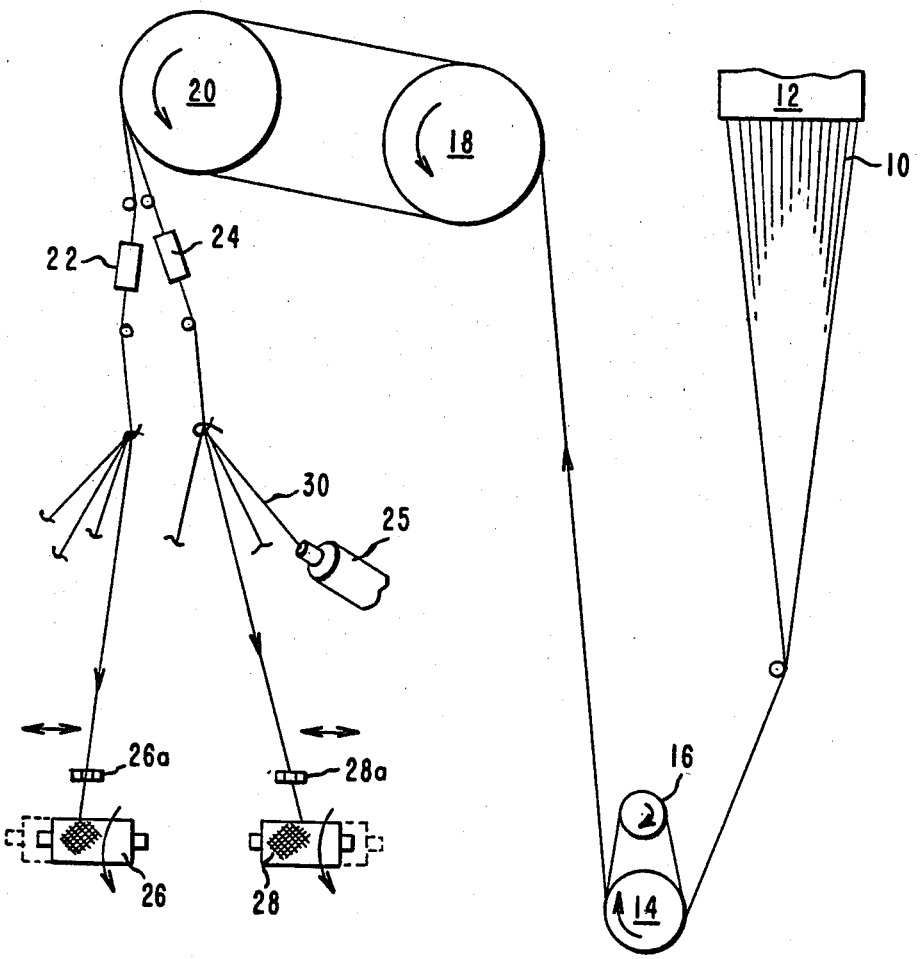
FIG. 1 is a schematic representation of a spinning machine in which the apparatus of this invention is used.

In the embodiment chosen for purposes of illustration (FIG. 1) a threadline warp 10 comprised of multiple individual threadlines is descending from spinneret 12 and around feed rolls 14, 16 from which they pass to draw rolls 18, 20, then through forwarding jets 22, 24 through transverse guides 26*a*, 28*a* to individual windups such as 26, 28. A vacuum stringup gun 25 is shown in position adjacent windup 28 to pick up an unstrung threadline designated 30. The vacuum stringup gun may be of the type disclosed by Miller in U.S. Pat. No. 2,667,964.

Figure 2:
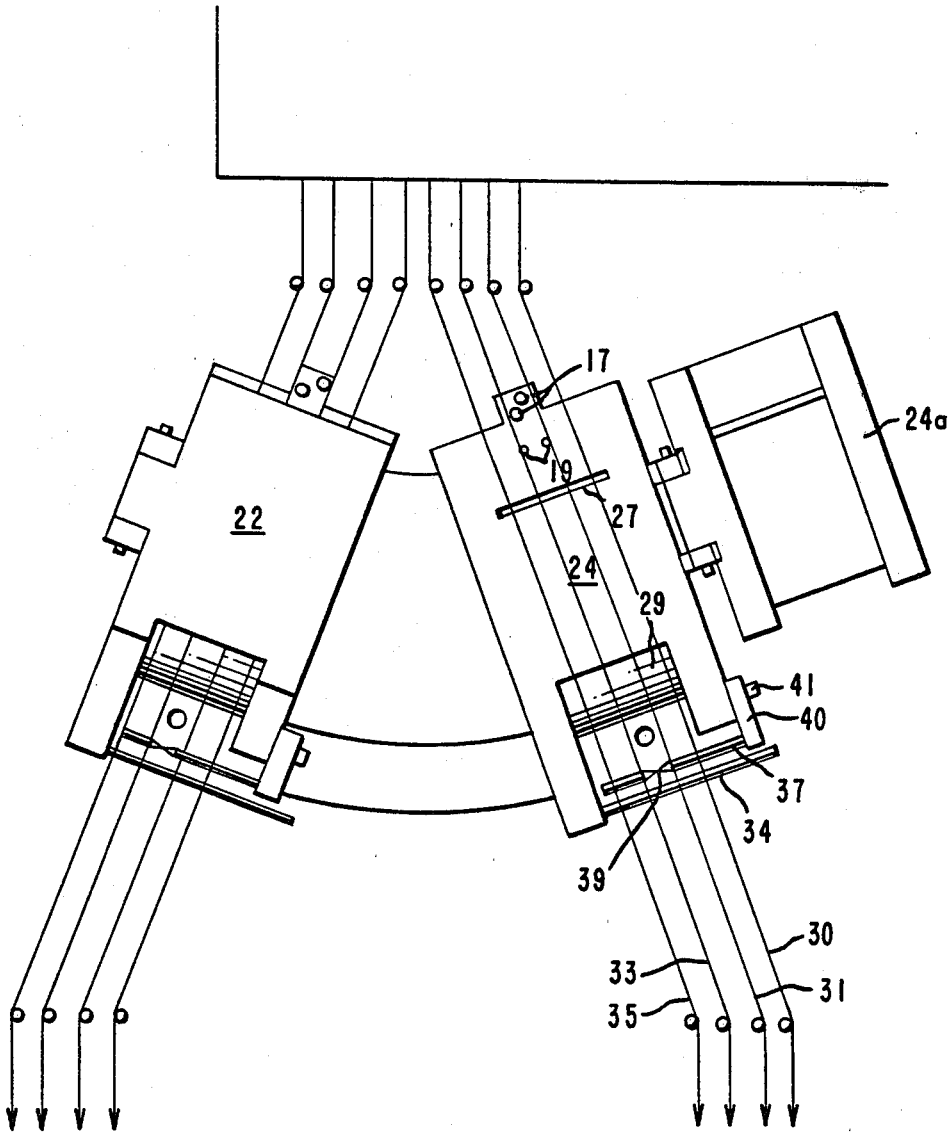
FIG. 2 is an enlargement of the portion of FIG. 1 showing the forwarding jets.

As shown in FIG. 2, four individual threadlines are passing through each of the forwarding jets 22, 24 from the draw rolls. Referring particularly to jet 24, the individual threadlines are designated 30, 31, 33, and 35, and are shown passing through the jet passage with the hinged jet cap 24*a* in the open position.

Figure 3:
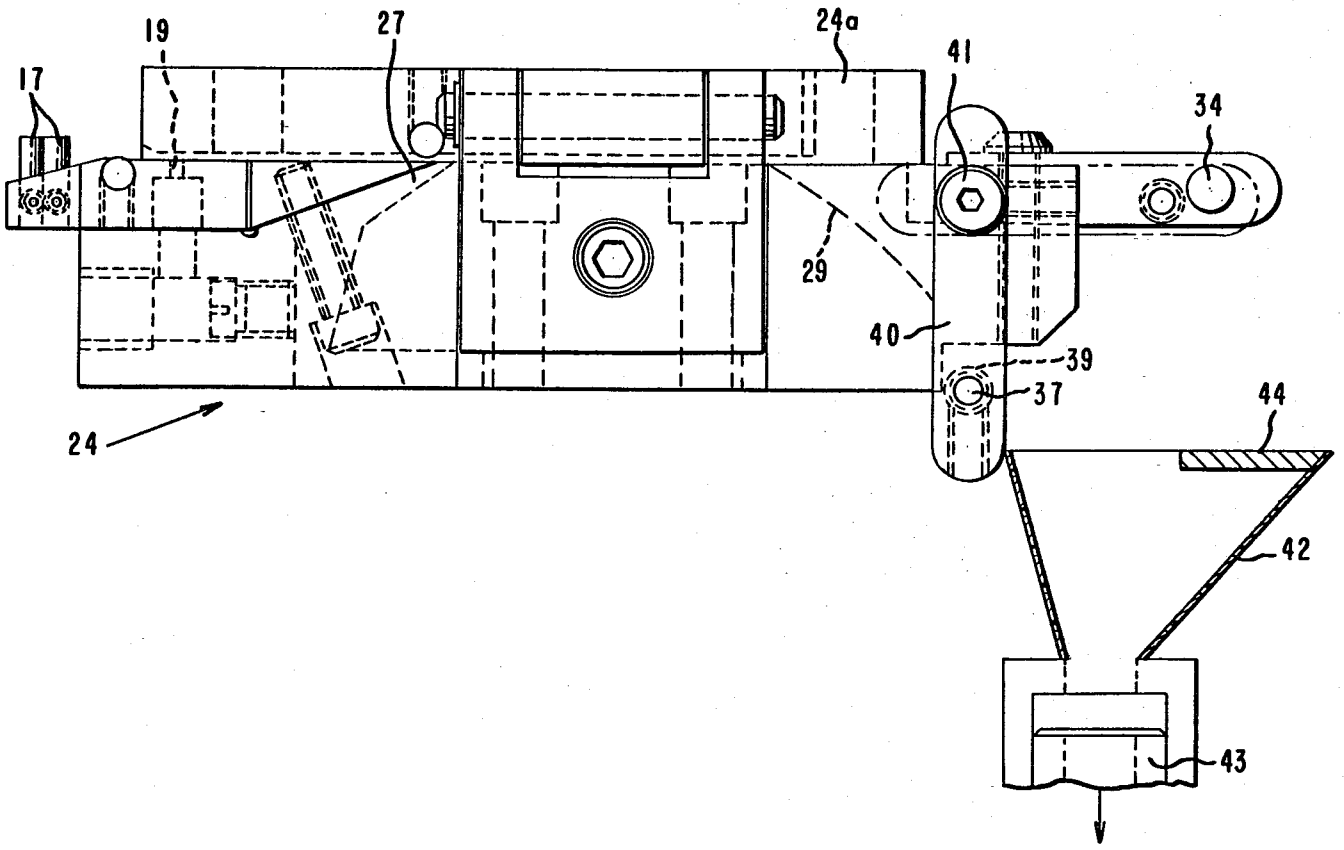
FIG. 3 is a side view of one of the jets of FIG. 2.

As can be seen, the threadlines pass by upstanding guide pins 17 then oven interlace jet orifices 19 and slot orifice 27 before passing over coanda surface 29 and leaving the outlet end of the jet. Attached in a fixed position to the outlet end of the jet is first elongated guide pin 34 located across the threadline contacting the multiple threadlines 30, 31, 33 and 35. Pivotally mounted on the opposite side of the jet 24 from pin 34 is a second elongated pin 37 preferably having a notch 39 centrally located in its surface. The pin 37 is fixed to an arm 40 that is pivotally mounted from the side of the jet body by means of a shoulder bolt 41. As best shown in FIG. 3, a pyramid-shaped foraminous basket 42 which is connected to a source of suction, such as a waste jet 43, is located below the guide pins 34, 37. A baffle 44 encloses a portion of the open top of pyramid-shaped basket. During a fumble or a missed string-up, the air flowing over the coanda surface 29 guides the broken threadline end into the entrance of basket 42. The basket diffuses the air and delivers the threadline to the waste jet 43. The baffle 44 prevents the broken end from escaping with the coanda air stream.

Figure 4:
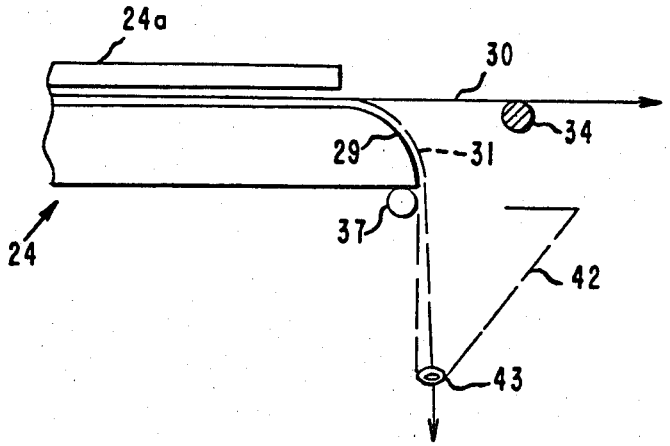
FIGS. 4, 5 and 6 are partial schematic representations of the forwarding jet of this invention showing the steps for recovery of an unstrung end.
Figure 5:
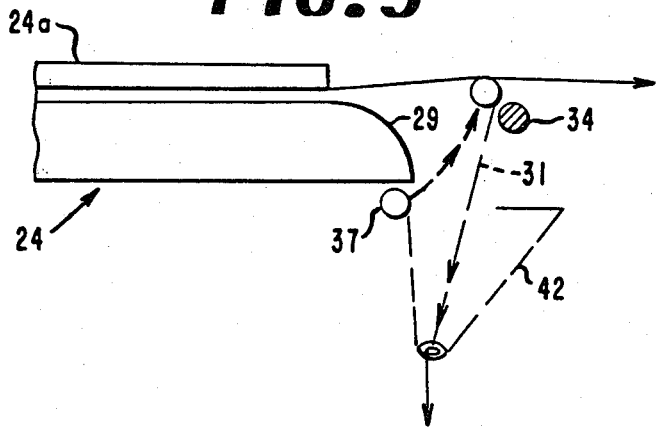
Figure 6:
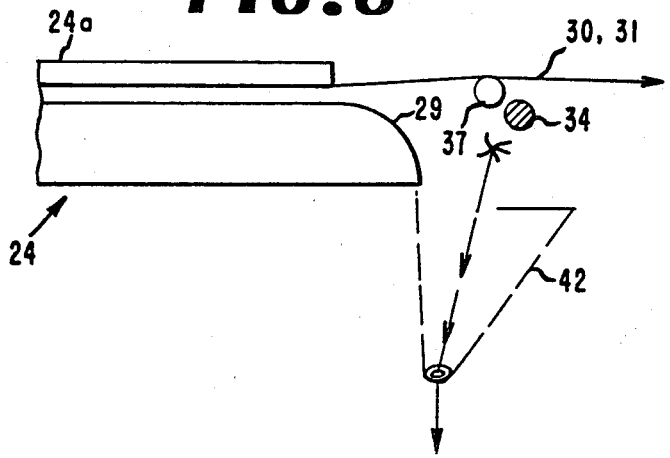

FIGS. 4, 5 and 6 illustrate the operating procedure to recover a broken threadline end (e.g., 31). The broken end 31 and a proper running end 30 are lifted and placed between guide pins 17 (FIGS. 2 and 3). The interlace jet 19 is activated and entangles the filaments of threadline 30, 31. The notched swing pin 37 is used to help recover the broken end 31 from the waste jet. While the broken end 31 travels over the notched swing pin 37 and into waste jet 43, the swing pin 37 is moved to contact the running threadline end 30 (FIG. 5). The broken threadline end 31 is pulled forward along the normal threadline path by the running end 30 as it passes over the swing pin 37. The broken end filaments are usually severed when they hit the exit guide pin 34 or break from the combined force from the waste jet and sucker gun tensions. The result is a double end running to sucker gun 25 adjacent the windup 28. The ends may then be separated, placed in the proper traverse guides 28*a*, then restrung on windup 28.

Figure 7:
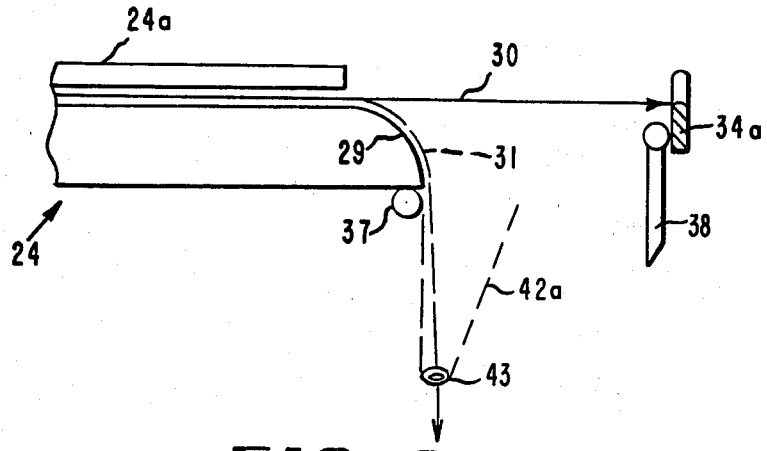
FIGS. 7, 8 and 9 are partial schematic representations of the forwarding jet of this invention showing the steps for recovery in an alternate embodiment using a pivotally mounted cutter blade.
Figure 8:
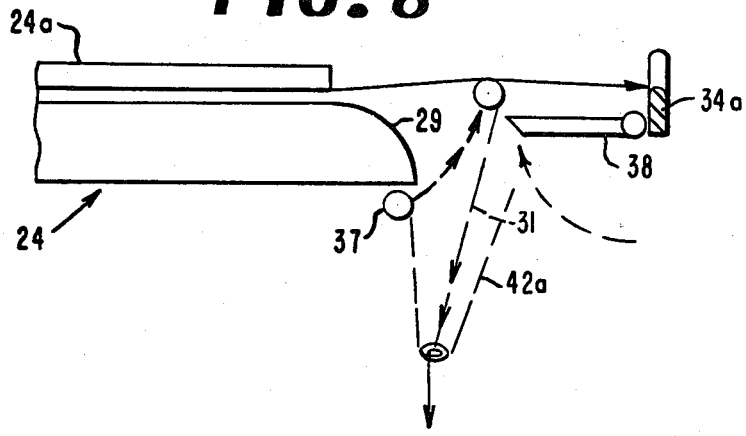
Figure 9:
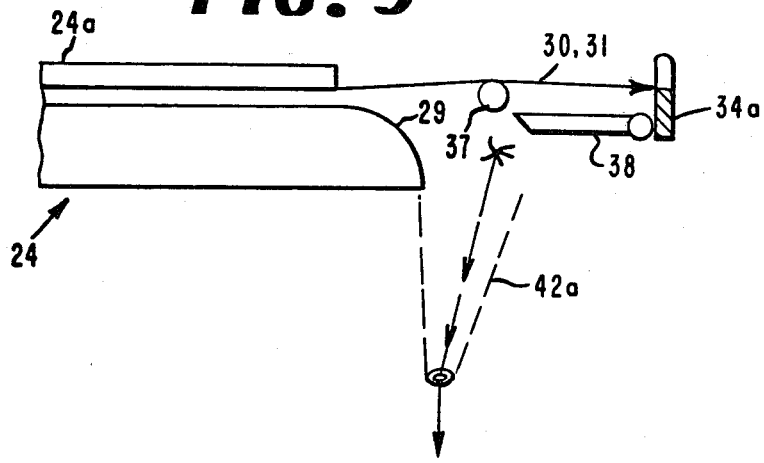

An alternate preferred embodiment is schematically shown in FIGS. 7, 8 and 9. This embodiment employs a comb guide 34*a* as a replacement for elongated guide pin 34 and a cutter blade 38 pivotally mounted between the comb guide 34*a* and the swing pin 37 which operates in conjunction with the swing pin 37 to recover the broken threadline 31. The cutter blade pivots upwardly to a location adjacent to the path that pin 37 takes when it is moved toward the level of moving threadline end 30. An improved foraminous basket 42*a* is now wedge-shaped. This design eliminates the need for the baffle 44.

In operation a proper running end 30 is centered over the interlace jet 19 and then the broken end 31 is moved sideways into the interlace zone. This will result in the filaments of the broken end 31 being progressively entangled into running end 30. As this happens these filaments are carried against the cutter blade 38 and severed. More particularly, the broken end 31 is picked up with swing pin 37 and raised to a level near the level of the normal path of the running end 30. Cutter blade 38 is pivoted to a position just downstream and just below the running threadline 30 adjacent and in close proximity to the path of the broken end 31 as it travels over the swing pin 37 and back to the waste jet 42*a*. The broken end 31 is carried against the cutter blade and severed. The result is a double end running to sucker gun 25 adjacent the windup 28. The ends may then be strung up on the windup 28.

I claim:

1. In a machine for processing multiple threadlines moving in a path from a supply source to a windup, an apparatus for stringing an unstrung threadline of said multiple threadlines that includes a jet adjacent said threadlines for interlacing the unstrung threadline with a moving threadline comprising: a forwarding jet located downstream of the interlacing jet, said forwarding jet having an inlet and an outlet through which said multiple threadlines pass in said path, said forwarding jet having a coanda surface located at its outlet; a suction device located below said coanda surface; a first elongated guide pin located across the threadline path contacting the moving multiple threadlines adjacent the outlet of the forwarding jet; and a second elongated pin having a notch in its surface at its center pivotally mounted at the outlet of the forwarding jet for swinging movement from a location below said coanda surface and above said suction device past said suction device to a location between the outlet of the forwarding jet and said first guide pin and above and across the threadline path.

2. The apparatus as defined in claim 1, wherein said suction device comprises a foraminous open top container having a source of suction in communication with the interior of said container, the open top of said container extending from said coanda surface to beyond the location of said first pin, and a baffle enclosing the portion of said open top location below said first pin.

3. In a machine for processing multiple threadlines moving in a path from a supply source to a windup, an apparatus for stringing an unstrung threadline of said multiple threadlines that includes a jet adjacent said threadlines for interlacing the unstrung threadline with a moving threadline comprising: a forwarding jet located downstream of the interlacing jet, said forwarding jet having an inlet and an outlet through which said multiple threadlines pass in said path, said forwarding jet having a coanda surface located at its outlet; a suction device located below said coanda surface; a first guide located across the threadline path contacting the moving multiple threadlines adjacent the outlet of the forwarding jet; an elongated pin pivotally mounted at the outlet of the forwarding jet for swinging movement in a path from a location below said coanda surface and above said suction device past said suction device to a location between the outlet of the forwarding jet and said first guide and above and across the threadline path; and a cutter blade pivotally mounted between said first guide and said elongated pin for swinging movement to a location adjacent to the path of said pin.

4. The apparatus as defined in claim 3, wherein said suction device comprises an open top foraminous container having a source of suction in communication with the interior of said container, the open top of said container extending beyond said coanda surface.

* * * * *